United States Patent [19]

Hoyt et al.

[11] Patent Number: 4,499,698

[45] Date of Patent: Feb. 19, 1985

[54] METHOD AND APPARATUS FOR ANCHORING RETAINING WALLS AND THE LIKE, AND INSTALLATION THEREFOR

[75] Inventors: Robert M. Hoyt; Donald E. Bobbitt; Gary E. Bartee; Stanley C. Garton, all of Centralia; J. Paul Pilliard, Columbia, all of Mo.

[73] Assignee: A. B. Chance Company, Centralia, Mo.

[21] Appl. No.: 462,361

[22] Filed: Jan. 31, 1983

[51] Int. Cl.[3] ..... E02D 5/74

[52] U.S. Cl. ..... 52/157; 405/258; 403/300; 175/122; 52/726

[58] Field of Search ..... 52/157, 726; 403/300, 403/301, 305, 306, 287, 379; 175/122, 257, 262; 405/258, 259, 262

[56] References Cited

U.S. PATENT DOCUMENTS

| | | | |
|---|---|---|---|
| 1,859,425 | 5/1932 | Bell | 14/176 |
| 2,347,542 | 4/1944 | Cyron et al. | 52/726 |
| 2,685,462 | 8/1954 | Lofquist | 403/300 |
| 2,829,503 | 4/1958 | Hayes | 403/305 |
| 3,148,510 | 9/1964 | Sullivan | 52/157 |
| 4,329,078 | 5/1982 | Crates et al. | 403/316 |

*Primary Examiner*—James L. Ridgill, Jr.
*Attorney, Agent, or Firm*—Schmidt, Johnson, Hovey & Williams

[57] ABSTRACT

A recoverable earth-retaining wall anchoring device and method is disclosed which allows the erection of a retaining wall in a quick, inexpensive manner and permits proof-load testing of the anchor during or immediately after installation, resulting in significant time and cost savings. The device includes a screw anchor having a central, elongated shaft with one or more outwardly extending helical blades affixed thereto, and an earth-penetrating lead point at one end. An adapter is attached to the anchor shaft and includes an opposed, threaded bore which receives an elongated threaded rod; a polygonal in cross-section engagement area is also provided between the opposed ends of the adapter. A wrench, having one or more releasably interconnected, tubular, polygonally-shaped shank sections is telescoped over the rod and operably and drivingly engages the adapter engagement area such that axial rotation of the wrench effects corresponding rotation of the anchor for installation and removal purposes. Multiple wrench shank sections are telescopically interfitted and releasably joined together by means of a spring biased locking dog inserted in aligned shank apertures. This dog is substantially flush mounted on the outer wrench section by means of an elongated, flat leaf spring which can be alternately positioned for maintaining the dog in a locking or a recessed position. The wrench may be easily removed from the soil because of the substantially flush configuration of the spring dog locking mechanism. The installation torque may be used to infer anchor load-bearing capacity and additionally, the device may be accurately proof-load tested and used immediately after installation, thereby eliminating costly construction delays. After the anchor is installed, the elongated rod is secured to the retaining wall thereby restraining the adjacent earth mass from lateral shifting.

8 Claims, 16 Drawing Figures

Fig. 10.
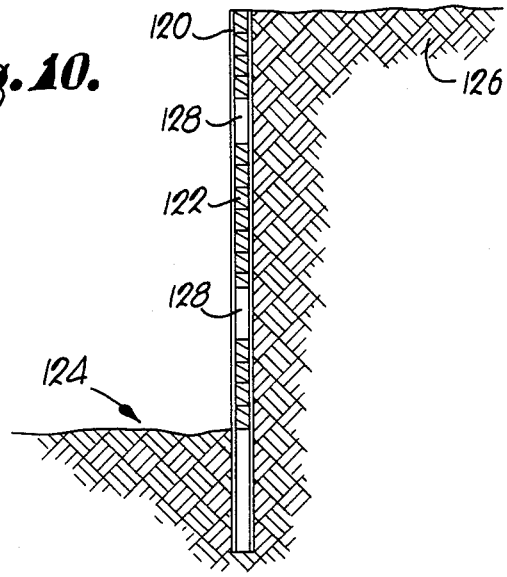
Fig. 11.
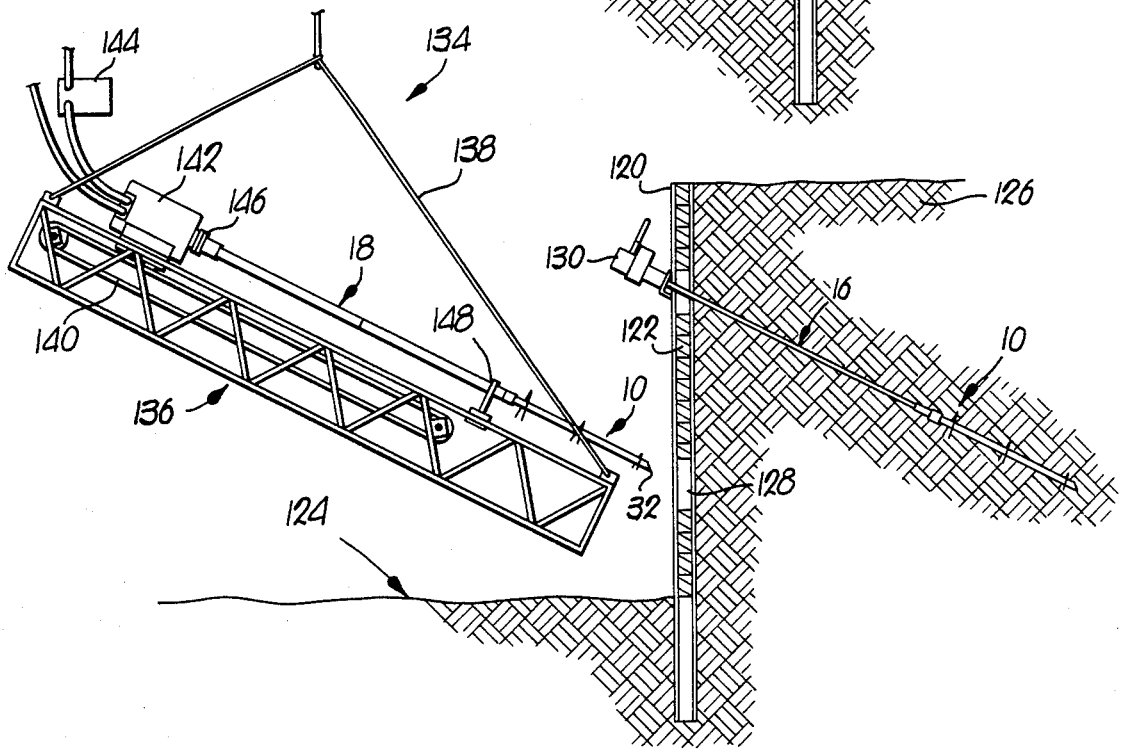
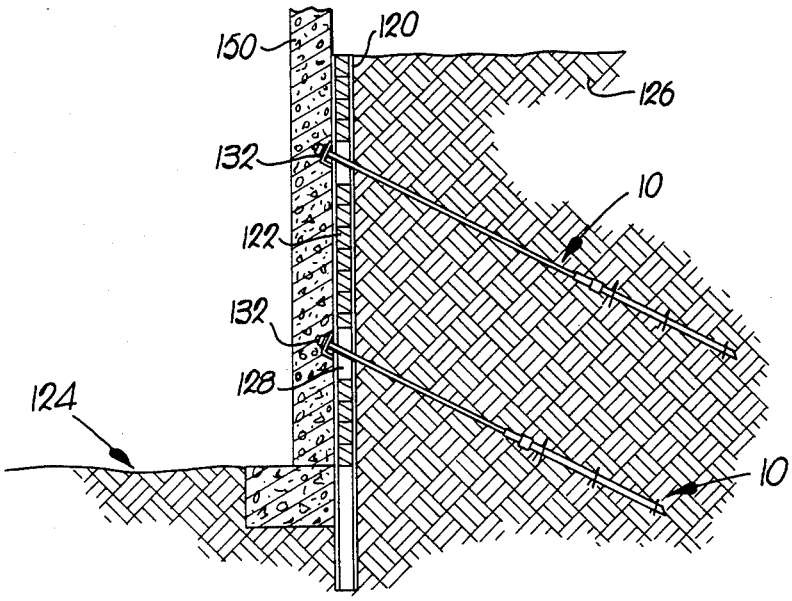
Fig. 12.

Fig. 13.
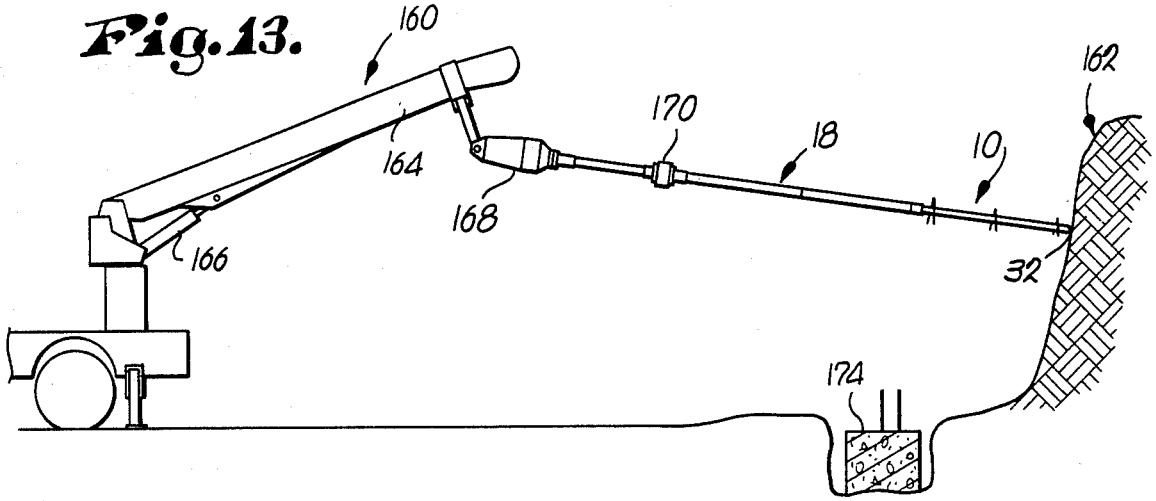
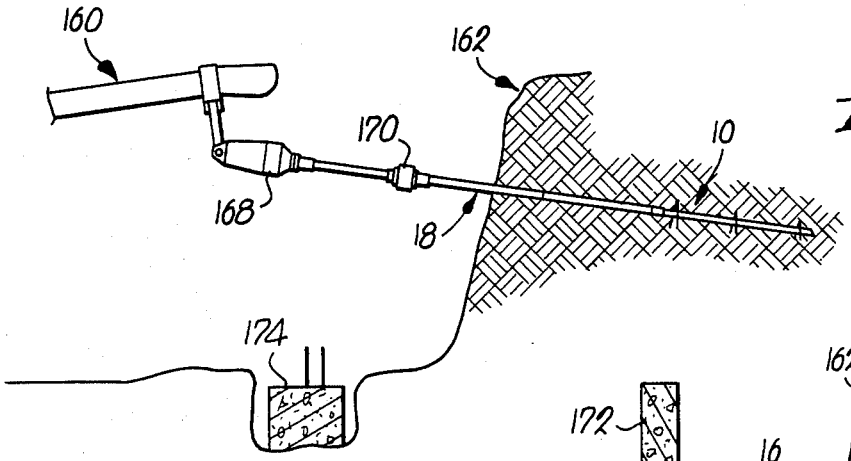
Fig. 14.
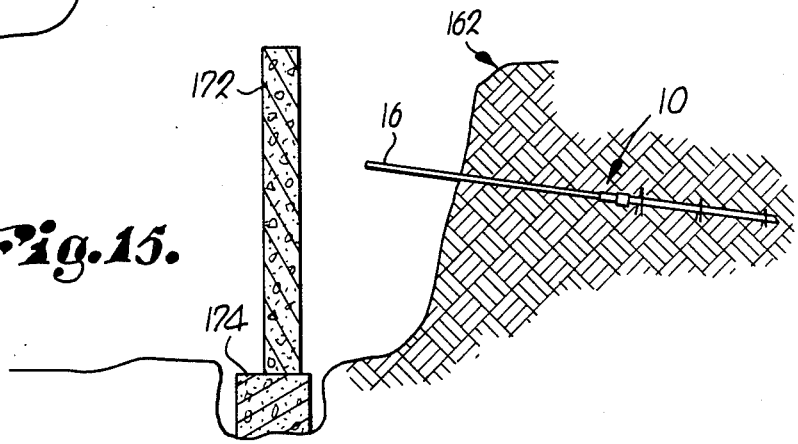
Fig. 15.
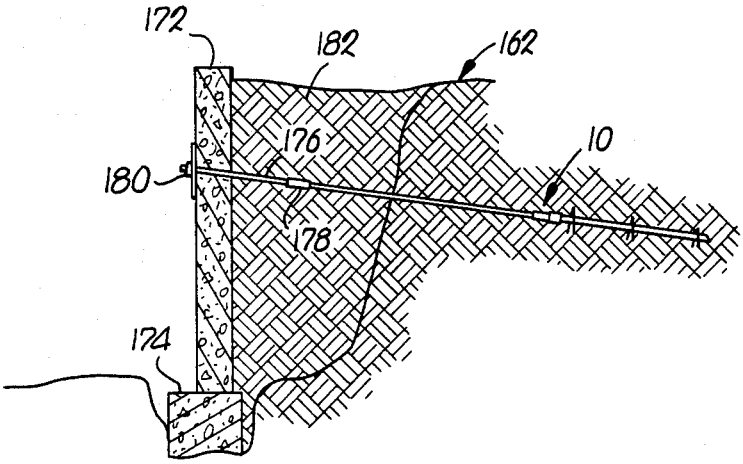
Fig. 16.

METHOD AND APPARATUS FOR ANCHORING RETAINING WALLS AND THE LIKE, AND INSTALLATION THEREFOR

BACKGROUND OF THE INVENTION

1. Field of the Invention

The present invention is concerned with an improved, tension element anchor apparatus used to restrain retaining walls for earth slopes, excavations and the like, (and a method of installing the same) which is characterized by ease of installation and low utilization expense. More particularly, it is concerned with a tension element anchor apparatus having a screw anchor member connected to an elongated rod by means of a specialized polygonally-shaped drive adapter, and which is designed to be installed in the earth by a screw anchor wrench having one or more elongated, tubular shank sections. Advantageously, multiple shank sections are releasably joined together by a flush-mounted, spring biased dog. A prime feature of the anchor apparatus and method, in accordance with the invention, is that the anchor apparatus may be quickly installed using commonly available equipment producing an anchor apparatus having a consistent load capacity which can be proof-loaded and put into service immediately and yet can be completely recoverable if desired.

2. Description of the Prior Art

Earth-retaining walls, whether temporary or permanent, are used in a wide variety of construction projects, for example in restraining earth slopes, retaining building excavations, and terracing. Essentially, such retaining walls are used to restrain the lateral pressures arising in an adjacent, retained earth mass. The retaining wall usually is oriented in an upright position to effectively restrain these lateral pressures. Although in some limited applications a wedge might be placed in the excavation site to prop up the upright retaining wall, in most applications, it is preferable to secure the retaining wall in some manner to the retained earth mass.

The most widely used present day device for securing a retaining wall to the adjacent earth mass is a combination of an elongated threaded rod encapsulated in cement, where the rod extends laterally through the retaining wall into the earth mass, with one end secured in the earth mass by cement and the exposed end fastened to the retaining wall. Typically, in this type of construction, a lateral hole is first augered in the earth bank to a desired length. Next, depending on the permanency of the anchor, the threaded rod tension element is inserted through a tubular sheathing such that both ends of the rod are exposed. The rod and tubular sheathing is then inserted in the laterally extending hole, leaving one end of the rod exposed at the face of the earth bank. Cement grout is then injected between the rod and sheathing such that the grout is funneled between the rod and sheathing along the length of the rod. At the point where the sheathing terminates, the grout fills the void in the augered hole around the rod, encapsulating the rod end such that, upon hardening, the grout bonds the inboard end of the rod in the earth. After hardening of the grout, the outer face end of the rod is then secured to the wall structure.

Although this grouted rod arrangement is well-established, a myriad of problems are connected therewith, resulting in significant delay and expense. One of the most serious of these difficulties is the necessity to accommodate the curing time of the cement grout. Before the exposed end of the tension element rod can be utilized, a sufficient time must be allowed to enable the grout to cure and harden (seven days is not uncommon). Of course, this period of delay translates into delays for other portions of the construction project, and therefore often represents a major factor in the length of construction time.

A second problem associated with this grouted rod anchor is that once installed, the anchor is extremely difficult to remove from the earth. Often, it is desirable to remove the anchor once its function has been served. For example, in a building excavation it is often desirable to temporarily anchor a retaining wall while the permanent foundation is being constructed. However, the time and expense of excavating the grout and rod from the earth mass dictate that these prior art anchors are more economically abandoned than recovered. In some cases, however, such earth anchors must be recovered to allow for subsequent excavation and construction where the anchor is located, resulting in a major recovery expense.

Added to the significant problems resulting from the use of these prior art anchors are major difficulties associated with the installation thereof. Typically, the drilling of the lateral holes in the retained earth bank produces a significant amount of earth spoils which must be disposed of from the excavation. Additionally, a large void space around the sheathing in the hole must be backfilled in some manner to prevent subsidence of the soil. Further, the equipment necessary to produce and install a grouted rod anchor often consists of several different pieces of specialized machinery, which are expensive to obtain and somewhat cumbersome on the construction site.

In addition to the foregoing problems, there are a number of difficulties associated with the soil mechanics and the construction methodology involved in constructing a sound retaining wall at a minimum cost when using grouted rod anchors. Typically, the first step in constructing a retaining wall is to first determine the retaining capability of the wall necessary to restrain the adjacent earth mass. If the soil composition were uniform along the earth mass, identical grouted rod anchors could simply be implanted with a uniform spacing between the anchors, such that the combined retention capability exceeded the minimum design load strength necessary for the retaining wall. Often, however, the soil composition of the earth mass can vary greatly over the length of the retaining wall, thus varying the anchor retaining capability of the soil in which the anchor is implanted. Because of this soil variability, use of the common grouted rod anchor leaves the engineer with essentially only two choices: first, the soil can be tested along the length of the wall at designated anchor installation points, and the grouted rod anchors constructed to meet the area load requirements of the particular wall section corresponding to these installation points; alternatively, the engineer could assume the worst and install both the quantity and size of anchor necessary on a "worst case" basis. Obviously, both of these options are deficient in terms of the time and expense involved.

Another variable in the effective anchorage of an earth retaining wall is the dynamics of the earth bank adjacent the retaining wall. Generally, the earth mass extending laterally behind the wall is divided into two zones, although the division between the two zones is rather imprecise. First, is an "active" zone immediately adjacent the retaining wall which tends to move with the wall movements and thus is ineffective in restraining the wall. The second zone is an "inactive" zone, adjacent the "active" zone and remote from the retaining wall; the earth in this zone is generally stationary. Therefore, the appropriate locus for implantation of the anchor is the "inactive" zone to assure that the retaining wall is effectively secured.

A further variability in constructing a grouted rod anchor is the inherent installation uncertainty associated with this type of construction. For example, the climatic conditions such as temperature and soil moisture are major factors in the curing time of the grout. Additionally, the angle of the lateral hole and the rod position in the grout bear on the installed strength of the anchor. The installation error, soil variability and the requirement to have the anchor secured in the "inactive" zone, all necessarily require the contractor to proof-load test each anchor to insure that it will meet or exceed the design requirements. However, as may be appreciated, the grouted rod anchor cannot be proof-load tested before the grout has sufficiently hardened. Additionally, as those skilled in the art will appreciate, for a proof-load test to be valid, it should only measure the strength of the anchor in the "inactive" zone. That is, the contractor must take measures to assure that the rod/sheathing arrangement is not restrained during testing by the "active" zone of the earth through which it passes. Therefore, to test the anchor it is necessary to provide the anchor with an "unbonded" section through the "active" zone of the retained earth mass. This "unbonded" section can take many forms, such as a delay in backfill of the hole or a steel tubing telescoped over the sheathing, but in any event further adds to the expense and delay.

It is known in the art to secure an earth retaining wall using a device which includes a screw anchor, but in the known attempt the results have been less than satisfactory. In the known attempt, an earth anchor, having a square, elongated shaft with axially spaced, helical blades secured thereto, was rotatingly driven into a bank of earth leaving the end thereof exposed. The necessary embedment distance of the anchor from the bank face was achieved by successively adding square, elongated shaft sections to the anchor shaft to extend the effective length thereof as embedment proceeded. The final shaft section included a necked-down, threaded reducing end. This reducing end was coupled to an upright wall by means of an appropriate nut threaded onto the reducing end. A significant problem encountered with this type of anchor device and method stems from the fact that, because only the outermost end of the reducing end is threaded, the embedment length of the device is extremely critical. That is to say, if the anchor device is embedded to a point where connection of the threaded end is possible, the device often is not situated for adequate holding in the earth. In this event, it is necessary to either add another section in an attempt to achieve a suitable shaft length or remove the device and reinstall it in another location.

SUMMARY OF THE INVENTION

The problems outlined above are in large measure solved by the anchor apparatus and method of installation in accordance with the present invention. That is to say, an installed anchor apparatus hereof may be immediately utilized and proof-load tested or alternatively, the proof-load test inferred from the method of installation of the anchor apparatus. Additionally, the present invention produces no spoils to be disposed of, voids to be backfilled, may be installed with equipment common on a typical construction site, and the anchor apparatus of the present invention inherently provides for an unbonded section through the "active" portion of the retained earth mass to facilitiate proof-load testing of the anchor construction. Further, use of the present invention virtually eliminates the need to backfill soil voids along the length of the tension element.

The anchor apparatus of the present invention broadly includes an anchor member having an elongated shaft and an outwardly extending load bearing member secured to the shaft, an elongated rod tension element, a drive adapter secured to the anchor shaft on one end and secured to the elongated rod at the other end with a polygonally-shaped drive section therebetween, and a tubular wrench operably coupling the drive section of the adapter such that axial rotation of the wrench in turn rotates the anchor member through the drive adapter. The elongated, tubular shank wrench may consist of one or more members which are releasably interconnected by a specialized coupling device in accordance with the invention. Broadly, the releasable coupling device connecting the telescopically interfitted, apertured shank members includes a locking pin of a sufficient length to extend through the apertures when aligned and an elongated flexible, spring bar operably coupled to the pin. The spring bar is in turn mounted on the outermost shank member by structure allowing the pin to be releasably and alternately inserted and withdrawn from the apertures. As may be appreciated, the installation of such a device in an earth bank thereafter allows for the placement of an upright load bearing element which, when coupled to the device, contacts and supports the bank of earth.

In particularly preferred forms, the anchor member is a screw anchor having an elongated shaft, multiple helical blades spaced thereon, an earth penetrating lead at one end of the shaft, and at the other end the drive adapter for connection of the anchor to an elongated threaded rod. The drive adapter has a square cavity at one end which receives the square anchor shaft; the adapter and shaft have complemental, aligned apertures in which a cross-pin is inserted thereby securing the shaft in the cavity. The other end of the adapter has a tapped bore into which the elongated rod is threaded. The middle of the adapter is square in cross section such that a complemental square, tubular wrench will operably engage and rotate the adapter. The length of the wrench is varied by adding shank sections using the releasable coupling device.

Preferably, the coupling device includes an apertured tubular insert interposed between two shank sections. The insert is preferably fixedly secured to the first shank section by a weld, exposing the apertured end of the insert. The second shank section includes a pair of identical locking mechanisms on opposed sidewalls at the distal end. Each locking mechanism preferably has a pair of elongated overlapping, relatively canted grooves, with the second groove shorter than the first. An aperture is centrally located in the grooves and two retaining bars overlie the distal ends of the adjacent grooves. An elongated spring bar, equal in length to the first groove, is attached to a cylindrical dog and placed in the shorter, second groove. In this position, the retaining bars secure the distal ends of the spring bar, necessarily outwardly bowing the middle of the spring bar and the attached dog to a point permitting relative movement of the sections. The tubular end of the shank section is then telescoped over the insert such that the respective apertures are aligned. Subsequent shifting of the spring bar to the first groove biases the dog inward through the aligned apertures, thereby locking the shank sections together.

The particularly preferred method of installation uses the preferred device to anchor the retaining wall. The wrench is brought into engagement with the drive adapter drive section with the wrench tube telescoped over the elongated rod. The lead point of the anchor is placed in contact with the earth bank and the wrench axially rotated. The rotation imbeds the screw anchor and the installation torque may be monitored to infer the load capacity of the installed anchor. The rod is coupled to the earth retaining wall and proof-load tested if desired. Several important variations to the preferred method are available. For example the wrench tube provides the anchor with an "unbonded" section through the "active" portion of the earth to accurately proof-load test the anchor. Additionally, if only temporary anchorage is desired, the elongated shaft of the anchor member may be lengthened as necessary to protrude from the bank allowing removal. A further variant, is installing the anchor without the rod attached and subsequently threading the rod to the adapter using the wrench tube as a guide. Finally, because the load capacity can be inferred during installation or measured immediately thereafter, the anchors can be installed to a constant embedment length and the spacing between anchors varied to achieve a predetermined load capacity for each section of the wall.

BRIEF DESCRIPTION OF THE DRAWINGS

FIG. 10 is a vertical sectional view of an excavation and an earth bank retained by vertically driven soldier piles with lagging inserted therebetween, and appropriate spaces therein, for insertion of the anchor apparatus in accordance with the invention;

FIG. 11 is a vertical sectional view similar to that of FIG. 10 illustrating a top upper anchor apparatus secured to the piling with a proof-load tester attached to the rod, and a lower anchor apparatus about to be installed;

FIG. 12 is a vertical sectional view similar to FIG. 10, but illustrating a pair of installed anchor apparatus secured to the piling with a permanent wall erected adjacent the piling;

FIG. 13 is a side elevational view of the device in accordance with the present invention coupled with the type of equipment that might be used in an earth slope application;

FIG. 14 is a vertical sectional view of the bank of an earth slope with the anchor apparatus being installed and the installment torque being measured;

FIG. 15 is a view similar to that of FIG. 14 depicting the wrench and the equipment removed and the retaining wall erected; and FIG. 16 is a view similar to that of FIG. 15 illustrating the anchor device coupled to the retaining wall with backfill inserted.

DESCRIPTION OF THE PREFERRED EMBODIMENT

Figure 1:
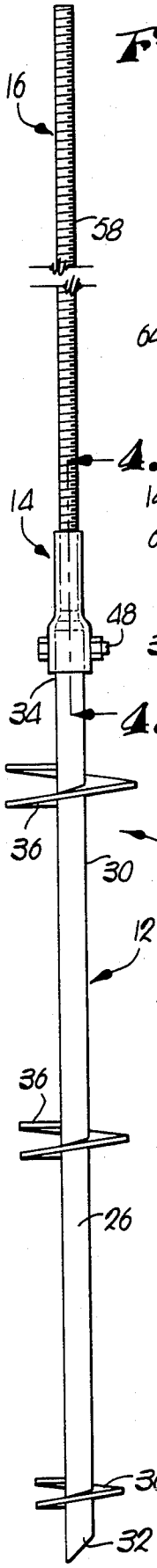
FIG. 1 is an elevational view of an anchor member, adapter, and elongated rod in accordance with the invention.

Turning now to the drawings, and particularly FIGS. 1–9, a tension element anchor apparatus 10 in accordance with the invention is illustrated. Broadly speaking, the anchor appartus 10 includes an elongated anchor member 12, a drive adapter 14 secured to one end of the anchor member 12, and an elongated rod 16 secured to the drive adapter 14 opposite the anchor member 12. An elongated wrench 18 is operably coupled to the drive adapter 14 and includes shank sections 20 and coupling devices 22.

In more detail, the anchor member 12 illustrated in FIG. 1, comprises an elongated, square in cross-section, central shaft 30 having a solid, angular, earth-penetrating lead point 32 at one end and an opposed, square connection end 34 having an aperture 28 therethrough. The shaft 30 thus presents four interconnected relatively perpendicular sidewalls 26. A plurality of laterally-spaced, helical blades 36 are affixed to shaft 30 and are coaxial with, and extend outwardly from, the shaft 30.

Figure 4:
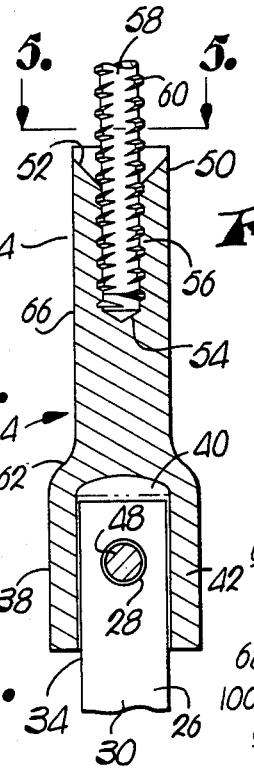
FIG. 4 is an enlarged vertical sectional view of the drive adapter taken along line 4—4 of FIG. 1.
Figure 5:
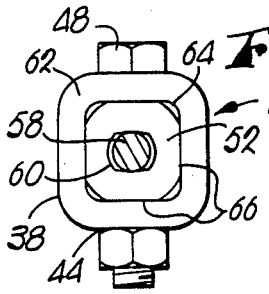
FIG. 5 is a horizontal sectional view taken along line 5—5 of FIG. 4.
Figure 2:
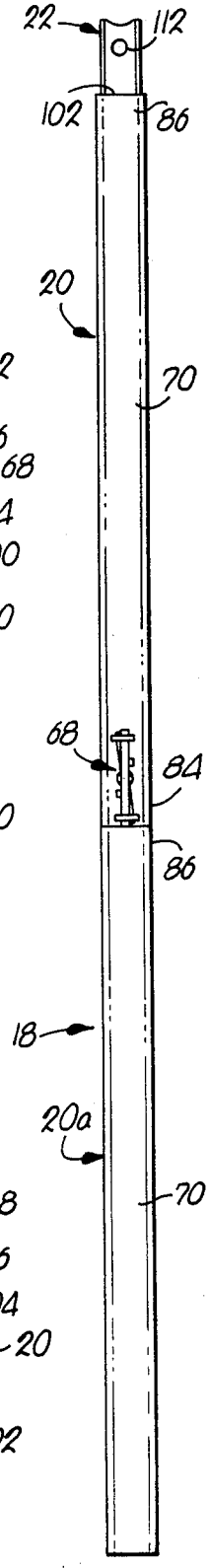
FIG. 2 is an elevational view depicting two wrench sections interconnected by a coupling device in accordance with the invention.

The drive adapter 14 is adapted for securement to the connection end 34 of shaft 30 by a tubular end 38 which defines a square, axial cavity 40 which slidingly receives connection end 34. Sidewalls 42 of telescoping end 38 thus adjoin and are complemental with sidewalls 26 of the shaft 30. An aperture 44 is provided through the opposed sidewalls 42 of end 38 and is oriented to align with aperture 28. An elongated crossbolt with nut 48 is also provided for insertion through the aligned apertures 44, 28, thus securing the connection end 34 in cavity 40. The adapter 14 also includes a bored end 50 opposite end 38 and which is configured for receiving the elongated rod 16. As best seen in FIG. 4, the bore end 50 is chamfered as at 52, and has an elongated axial bore 54 extending therein which is tapped to present wall threads 56 along the length of bore 54.

The rod 16 is an elongated, cylindrical, steel shaft 58 of complemental diameter for insertion in bore 54. Preferably, the shaft is hot rolled to form a pattern of outwardly extending helical ribs 60 which assume a thread-like configuration such that axial rotation of the shaft 58 serves to thread rod 16 into the bore 54, with the joinder of the ribs 60 and threads 56 providing a secure connection. The outer surface configuration of adapter 14 between the ends 38, 50 includes a necked region 62 along with a square in cross-section drive region 64 having four interconnected drive faces 66.

Figure 3:
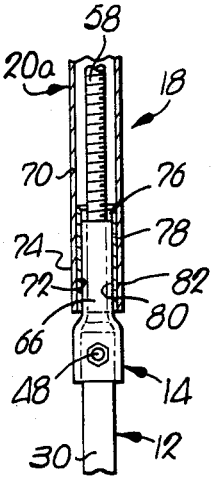
FIG. 3 is a vertical sectional view of the wrench telescoped over the rod and engaging the drive adapter.

The tubular drive wrench 18 has a number of tubular shank sections 20, the number depending upon the length of the wrench 18 desired. In order to provide a mating configuration relative to adapter drive region 64, the shank sections 20 are square in cross-section and present four interconnected sidewalls 70 having respective inner and outer faces 72, 74. FIG. 3 shows a first shank section 20*a* telescoped over the rod 16 and engaging drive adapter 14 at region 64. Section 20*a* is identical with the other sections 20 making up the overall wrench, save for the fact that the adapter-engaging end of section 20*a* is provided with a square in cross-section tubular insert 76 having sidewalls 78, respectively presenting inner and outer faces 80, 82. The bore of insert 76 is dimensioned to telescopically receive and drivingly engage the region 64 of adapter 14.

Each of the shank sections 20 includes a releasable end 84 and a coupling end 86. In the preferred embodiment, the releasable end 84 includes a pair of opposed locking mechanisms 68 in opposed sidewalls 70. One of the mechanisms 68 is herein described with the understanding the other mechanisms are identical in all details. The mechanism 68 includes a shallow, elongated, longitudinally-aligned, first groove 88 formed in the outer face 74. A shallow, elongated, second groove 90 is formed in the outerface 74 of sidewall 70, but is slightly shorter in length than first groove 88. Groove 90 is adjacent and communicates with and overlaps groove 88, but is canted slightly relative thereto. A flattened, elongated, retaining bar 92 is affixed to the outer face 74 overlying the distal ends of both first and second grooves 88, 90. A circular aperture 94 extending through the sidewall 70 is centrally located in the common region of grooves 88, 90. A pair of square, tool-receiving cavities 96 are located adjacent the first groove 88 between the aperture 94 and the retaining bars 92. A solid, cylindrical, retention dog 98 complementally configured for sliding reception within the aperture 94 is centrally affixed to an elongated, flexible, flattened spring bar 100. The length of the spring bar 100 is approximately the same as the first groove 88 and is complementally configured for reception therein, such that when the spring bar 100 lies in the groove 88 the distal ends of the spring bar 100 are secured by the retaining bars 92, and the retention dog 98 received in aperture 94 extending beyond the inner face 72.

The coupling end 86 is configured for sliding reception of the tubular coupling device 22. In the preferred embodiment the device 22 is received approximately half way into end 86 and secured therein by weld 102. The coupling device 22 is square in cross-section, presenting four sidewalls 104 having respective inner and outer faces 106, 108. Each of the distal ends of the coupling device 22 has a chamfer 110, and the exposed end of the device 22 remote from coupling end 86 has a circular aperture 112 extending through the respective sidewall 104.

In use, the assembly of the anchor apparatus 10 is accomplished by sliding the cavity 40 of drive adapter 14 over the connection end 34 of the screw anchor member 12 such that the respective apertures 44, 28 are aligned. The cross bolt with nut 48 is the inserted through the apertures 44, 28 such that the end 38 is secured to the connection end 34. In the preferred embodiment, the elongated rod 16 is next threaded into the bore 54 thereby securing it in place. The wrench 18 is next brought into engagement with the drive adapter 14 by telescoping the initial section 20*a* over rod 16 until insert 76 comes into driving engagement with the region 64.

Figure 7:
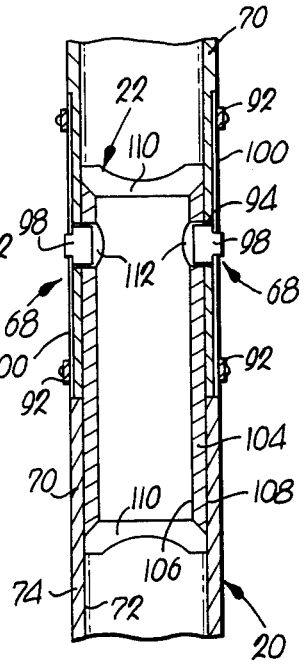
FIG. 7 is an enlarged vertical sectional view of the device illustrated in FIG. 6.
Figure 6:
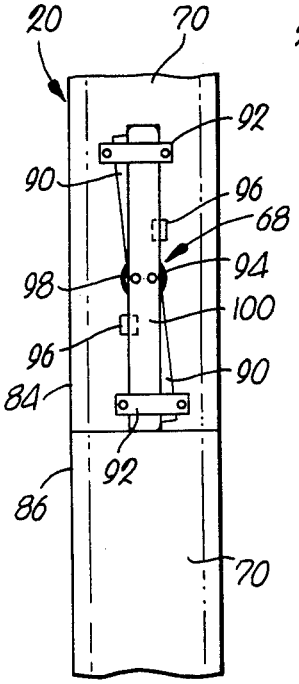
FIG. 6 is an enlarged, side elevational view of the joinder of two wrench shank sections with the spring biased dog in the locked position.
Figure 9:
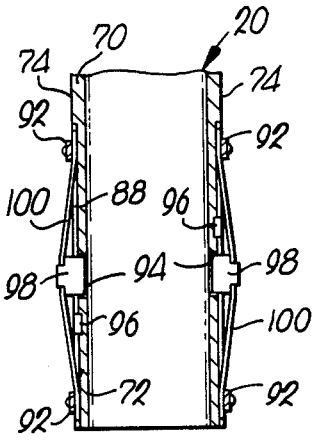
FIG. 9 is an enlarged vertical sectional view of the device illustrated in FIG. 8.
Figure 8:
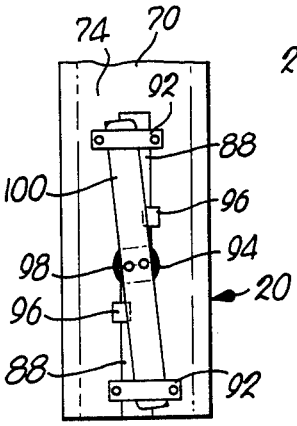
FIG. 8 is an enlarged side elevational view of the spring biased dog in the unlocked position.

The length of the wrench tube 18 is then extended to the desired length by coupling several shank sections 20 together. To couple two shank sections 20 together, it is first necessary to outwardly bias the retention dog 98 of each of the locking mechanisms 68. As seen in FIGS. 8–9, this is accomplished by inserting a screwdriver in the cavities 96 and prying the spring bar 100 such that the spring bar 100 is moved into the second groove 90. Because the length of groove 90 is less than the length of bar 100, the central region of spring bar 100 is outwardly bowed (FIG. 9) thereby outwardly biasing the retention dog 98 in such a manner that the retention dog 98 does not extend beyond the inner face 72. In this position, the releasable end 84 of a section 20 is telescoped over the coupling device 22 of adjacent section 20 such that the respective apertures 112, 94 are aligned. The two shank sections 20 are fixed in place by rotating the spring bar 100 in a clockwise direction as seen in FIG. 8, such that the spring bar is received in the first groove 88. As best seen in FIGS. 6–7, spring bar 100, when located in the first groove 88, inwardly biases the retention dog 98 such that the dog 98 extends into the aperture 112 of the coupling device 22. To disengage the two shank sections 20, the process is simply reversed.

FIGS. 10–12 illustrate a preferred installation method using a device in accordance with the invention in construction of a retaining wall. Beginning with approximately level ground, a plurality of steel, I-beam soldier piles 120 are vertically driven into the ground in a laterally spaced relationship. Next, the ground is excavated on one side of the soldier piles 120 and sheet piling or wooden timber lagging 122 laterally secured between the soldier piles as the excavation proceeds. This process thus presents an excavation 124 on one side of the soldier piles 120 and a retained earth mass 126 on the other side. As seen in FIG. 10, intermittent spaces 128 are left in the lagging as the excavation proceeds for later insertion of the devices 10.

FIG. 11 depicts a top anchor apparatus 10 already installed in the retained earth mass 126 with the elongated rod 16 extending beyond the soldier pile 120. A proof-load tester 130 connects the soldier piling 120 and the rod 16, and measures the holding power of the embedded anchor 10. The tester 130 simultaneously proof-loads the anchor and secures a holding nut and plate 132 to the rod 16, thereby connecting the soldier piling 120 to the anchor apparatus 10 at the required proof-load.

FIG. 11 also shows a lower anchor apparatus 10 coupled to a power wrench device 134. Broadly, the power device 134 includes a boom platform 136 suspended from an overhead crane (not shown) by a cable saddle 138. A powered conveyor track 140 is mounted in the boom platform 136, and in turn, hydraulic drive motor 142 is mounted on track 140. A torque measuring device 144 is used to measure the torque generated by the hydraulic drive motor 142 during installation of the anchor apparatus 10. A coupler 146 is mounted to the hydraulic drive motor 142 for receiving the square, tubular shank section 20 and an anchor guide 148 is mounted on the boom platform 136 for holding the other end of the wrench 18.

As shown in FIG. 11, the anchor apparatus 10 is held in the power device 134, and the boom platform 136 positioned by the crane such that the lead point 32 is aligned with one of the spaces 128. The hydraulic drive motor 142 is then actuated to axially rotate the wrench 18, in turn rotating the anchor member 12. The conveyor track 140 is simultaneously powered to laterally drive the hydraulic motor 142 (and thereby apparatus 10) down the length of the boom platform 136, causing the anchor member 12 to embed itself in the retained earth mass 126. During this installation procedure the torque measuring device 144 is monitored and the readings used to infer the holding capacity of the anchor apparatus 10 once installed. The wrench tube 18 is removed from the bank 126 and holding nut and plate 132 secured to the rod 16, thereby connecting piling 120 to anchor apparatus 10. FIG. 12 depicts a permanent concrete wall 150 constructed adjacent the piling 120 and lagging 122 combination, with the anchors left embedded.

As those skilled in the art will appreciate, many variations can be made in the preferred method of installation to accommodate particular applications, all within the scope of the invention. For example, the anchor may be proof-load tested after installation, the load inferred from the installation torque, or the anchor may not be load tested at all.

Another alternative is to rearrange the installation/-removal sequence of the rod, wrench tube and anchor. The rod may be connected to the anchor member before anchor installation, or after installation with the wrench tube still in place. Further, the wrench tube may be immediately removed from the earth bank after anchor installation or partially retracted and left in place until after proof-load testing. Finally, the anchors may be left embedded permanently, as shown in FIG. 12, or recovered either immediately prior to constructing the adjacent permanent wall section or even during construction of the permanent wall.

Still another important installation method of the anchor device of the present invention, is the method of installing a plurality of anchors in such a manner to meet or exceed the design load requirements of the entire wall and individual area sections of the wall. This method of installing a plurality of anchors is illustrated in FIG. 11. In this method, the load-bearing capacity of the wall necessary to support the earth bank is predetermined and accordingly, individual area sections of the wall assigned a minimum load capacity. As those skilled in the art will appreciate, it is difficult to inexpensively determine the spacing and number of anchors needed in each wall area because of the soil variability and anchor installation error. Therefore, as shown in FIG. 11, an anchor is installed and proof-load tested. If the load exceeds the predetermined load necessary to support for the surrounding wall area, the constructor moves to the next wall area. If the installed anchor is insufficient to support the surrounding wall area, another anchor is installed in the wall area spaced either vertically or laterally from the first anchor. In this method, identical anchor members can be installed to the same embedment depth and the spacing varied as necessary.

FIGS. 13–16 illustrate another application of the device and method of installation of the present invention, as might be used as an earth slope or terracing application. FIG. 13 depicts the anchor apparatus 10 affixed to a power installation rig 160 with the lead point 32 in contact with an earth slope 162. The rig includes a luffable jib 164 powered by a hydraulic cylinder. A hydraulic motor 168 is attached to the jib 164 to provide axial rotation to the anchor apparatus 10. The apparatus 10 is connected to the motor 168 with a torque monitor 170 in between.

FIG. 14 depicts the installation of the anchor 10 in the slope 162 with the torque monitor 170 used to infer load-bearing capacity of the anchor 10. In FIG. 15 the wrench 18 is shown removed, leaving the rod 16 exposed from the slope 162. A retaining wall 172 is constructed on the footing 174. As shown in FIG. 16, another length of elongated rod 176 is affixed to rod 16 by coupler 178. The rod 176 is then secured to the wall 172 by a plate and bolt 180 and backfill 182 compacted between the wall 172 and slope 162.

We claim:

1. In combination:

an elongated rod;

an anchor member including an elongated shaft and means affixed to said shaft for securing said shaft in the earth;

an elongated adapter separable from, and interconnecting said rod and said anchor member comprising a first end having means fixedly securing said rod to said adapter;

a second end having a cavity releasably receiving said shaft, and means fixedly securing said shaft in said cavity, a third section, polygonally-shaped in cross-section, intermediate said first and second ends, a tubular wrench shank telescoped over said rod and said third section, said shank being of complemental polygonal cross-sectional shape and dimensions relative to said third section for a mating fit driving engagement with said third section, such that axial rotation of said shank effects corresponding axial rotation of said adapter and anchor member.

2. The combination as set forth in claim 1, said anchor member shaft being polygonal in cross-section, and said adapter second end including a polygonally-shaped cavity complementally and slidably receiving a portion of said anchor shaft.

3. The combination as set forth in claim 2, said polygonal shape of said shaft and cavity being approximately square.

4. The combination as set forth in claim 1, said anchor shaft and said adapter including structure defining respective aligned apertures therethrough, said shaft securement means comprising a transversely extending, elongated pin received within said apertures.

5. The combination as set forth in claim 1, wherein said rod is threaded and said adapter first end means includes a complementally tapped bore receiving said rod.

6. The combination as set forth in claim 5, said rod threads comprising a plurality of discontinuous, spaced ribs along the length of said rod.

7. In combination:

an elongated rod;

an anchor member including an elongated shaft and means affixed to said shaft for securing said anchor in the earth;

means operably coupling said rod to said anchor;

a wrench, including a plurality of interconnected, elongated, tubular shank sections, telescoped over said rod and extending toward said anchor member;

structure drivingly connecting said wrench to said anchor, such that axial rotation of said wrench effects corresponding axial rotation of said anchor;

means operably connecting said multiple shank sections together, including a coupling insert received within the adjacent ends of said interconnected shank sections, and means securing said shank sections to said insert, said securing means comprising structure defining a pair of complemental, aligned apertures respectively extending through the wal of one of said shank sections and the adjacent wall of said insert, a retention dog, complementally configured for sliding reception within said apertures, said dog in a first position being inserted in both of said apertures thereby locking said one shank section and said insert in a telescopic relationship, said dog in a second position being disengaged from at least one of said apertures thereby releasing said one shank section from said insert; and means for selectively and alternately biasing said dog into said first and second positions, including an elongated, flattened, flexible, spring element operably coupled to said dog;

structure defining an elongated, spring element-receiving first groove of a first length in the outer face of said one shank section;

an elongated, element-receiving, second groove, adjacent and canted relative to said first groove, of a second length, shorter than said first length; and a pair of transverse, elongated, flattened retaining bars affixed to the exterior of said shank respectively overlying the adjacent distal ends of said grooves such that when said spring element is inserted in said first groove said dog is biased into said first position and when said spring element is rotated to said second groove said dog is outwardly biased into said second position.

8. The combination as set forth in claim 7, wherein said securing means is substantially flush with the outermost dimension of said one shank section in said locked position.

* * * * *